US006681545B1

(12) United States Patent
James

(10) Patent No.: US 6,681,545 B1
(45) Date of Patent: Jan. 27, 2004

(54) BUILDING REINFORCEMENTS

(76) Inventor: Peter James, 2 Redd Landes, Shirenewton, Chepstow, Gwent (GB), NP6 6QP ( * ) Notice: Subject to any disclaimer, the term of this patent is extended or adjusted under 35 U.S.C. 154(b) by 114 days.

(21) Appl. No.: 10/070,543

(22) PCT Filed: Sep. 7, 2000

(86) PCT No.: PCT/GB00/03415

§ 371 (c)(1),
(2), (4) Date: Mar. 7, 2002

(87) PCT Pub. No.: WO01/18344

PCT Pub. Date: Mar. 15, 2001

(30) Foreign Application Priority Data

Sep. 7, 1999 (GB) ..... 9921045
Dec. 10, 1999 (GB) ..... 9929122

(51) Int. Cl.[7] ..... F04B 1/34
(52) U.S. Cl. ..... 52/745.21
(58) Field of Search ..... 52/742.13, 742.14, 52/742.15, 742.16, 745.21, 740.1, 514.5, 213, 704, 707

(56) References Cited

U.S. PATENT DOCUMENTS 4,232,984 A * 11/1980 Sandahl
5,366,672 A * 11/1994 Albrigo et al.
5,562,377 A * 10/1996 Giannuzzi et al.
6,308,478 B1 * 10/2001 Kintscher et al.
2001/0034997 A1 * 11/2001 James

FOREIGN PATENT DOCUMENTS

| | | | |
|---|---|---|---|
| CH | 668 286 | 12/1988 | |
| DE | 34 12 0608 A1 * | 10/1985 | ..... E06B/9/01 |
| DE | 43 35 267 | 4/1995 | |
| FR | 1 066 373 | 6/1954 | |
| FR | 1 163 255 | 9/1958 | |
| FR | 1 451 738 | 12/1966 | |
| FR | 2 171 311 | 9/1973 | |
| GB | 1 405 083 | 9/1975 | |
| WO | WO 99/09277 | 2/1999 | |

* cited by examiner

*Primary Examiner*—Robert Canfield
(74) *Attorney, Agent, or Firm*—Young & Thompson

(57) ABSTRACT

A window is anchored more securely by removing the frame, drilling into the reveals of the window aperture between the faces of the wall, inserting into each drilling a rod encased in a loose fabric sleeve and injecting grout into the sleeve to expand it against the wall of the drilling, the grout permeating through the fabric and bonding to the wall. The ends of the rods are left exposed at the aperture and the frame is secured to them. Within the wall the rods may be looped and further drillings through the loops may be likewise filled by similar grouted reinforcements, linking several window anchorages together.

16 Claims, 5 Drawing Sheets

BUILDING REINFORCEMENTS

This invention relates to the reinforcement of buildings, particularly some time after their original construction.

There are many buildings in the world which are unlikely to stand up when shaken by a substantial earthquake or blasted by a terrorist momb. It is simply not practical to pull all these buildings down and start again, and therefore it is desirable to have some way of reinforcing them, preferably without impairing their appearance or destroying their utility.

Most modern buildings or significant size use reinforced concrete. Typically, there are vertical columns supporting slab floors in a vertical array, forming a basic structure to which cladding and internal partitioning are added later. Once the foundations are laid, a set of columns for the lowermost floor are constructed, the first operating being the setting up of metal cages whose principal members are vertical rods. Generally the columns are square or ractangular, and there is one rod at each corner. Shuttering is then placed around this cage and concrete poured and allowed to set. When all the columns have been completed, the first floor is cast, and there are generally left standing proud of the floor the upper ends of the rods of the initial columns. To these are tied further rods for the next set of columns and so on, storey by storey.

The tying of the rods is never particularly strong, and these are one of the weak points in the building.

There is a known method of reinforcing concrete, masonry and brick structures after construction. It comprises drilling into the structures, inserting a reinforcing rod enveloped by a loose fabric sleeve into the drilling, and injecting grout to expand the sleeve against the wall of the drilling and to penetrate through the fabric to bond to the structure. This will be referred to as the defined method.

The concrete columns in the building described above can be reinforced by this defined method, the centre of each column being generally free of reinforcing rod and therefore susceptible to being drilled without interference. It may also be possible to insert horizontal reinforcements and diagonal ones, across infills between columns. The basic structure can therefore be made substantially stronger than it was originally.

However, windows are a weak point. Ordinary glass shatters quite easily of course, but that problem has largely been overcome by using strengthened or armoured glass. However, this can be more robust than the frame in which it is set, and so the frame has to be upgraded as well. But, in the face of a substantial blast, the whole frame can blow out of the aperture in which it is set. So there is a need to anchor such frames more firmly.

It is the aim of this invention to strengthen buildings in this area.

According to one aspect of the present invention there is provided a method of reinforcing the anchorage of a frame (such as for a door or window) in an aperture in the wall of a building, the method comprising drilling into the reveals of the aperture from within the aperture, the drillings being between the inner and outer faces of the wall, inserting a reinforcing rod enveloped by a loose fabric sleeve into each drilling, leaving an end of the rod secured or securable to a frame within the aperture, and injecting grout to expand the sleeve against the wall of the drilling to penetrate through the fabric and bond to the wall.

Preferably the rod is curved back on itself at the distal end from the frame to form a loop. The loop may be open so that the rod is of thin J-shape, but preferably the rod is of thin U-shape with both ends proximal to and secured or securable to the frame.

In a development of this there can be two such U-shaped rods within the same drilling, one shorter than the other and nested with their planes substantially at right angles. But although that gives added strength, it is not suitable for the interlinking of these anchorages, as outlined below.

When the plane of a single loop anchorage is substantially at right angles to the wall, and when the grout has set, the wall may be drilled between its two faces so that the drill bit passes through the loop. Then an extra reinforcing rod enveloped by a loose fabric sleeve can be inserted in the drilling and grout injected to expand that sleeve against the wall of the drilling, also permeating through the fabric to bond to the wall. And when the aperture has a plurality of looped frame reinforcements along at least one side, the loops can be aligned to receive a common extra reinforcing rod.

Often a structure has an array of apertures with a corresponding set of aligned sides. With each such side having at least one looped frame reinforcement, a common extra reinforcing rod can be passed through all the loops associated with a set of aligned sides. And when there are two parallel arrays of apertures, the looped frame reinforcements of adjacent parallel sets of sides may overlap to be threaded by a common extra reinforcing rod.

However, while tests have suggested that this is an effective method of strengthening the anchorage of window frames and their surrounds, it is not always practical to reinforce a building to such an extent that it can withstand explosions of great power. It would be more sensible to make them resistive up to a certain point, but after that to allow some "give", to absorb the energy of a blast or seismic jolt by controlled movement.

According to another aspect of the present invention there is provided reinforcing rod for the defined method, the rod being composed of a plurality of sections coupled by energy absorbing means that fail at a predetermined critical load.

When there are more than two sections, the critical loads of the couplings need not be uniform throughout the rod. Some can be arranged to give way earlier than others so that there can be progressive and relatively controlled failure of the structure.

There are several ways of conveniently and economically forming an energy absorbing coupling. For example, two adjacent sections may overlap and be strapped together by an encircling element, or the overlapping portions could be transversely drilled to receive a shear pin. In another arrangement two adjacent sections can hook around a hollow member from opposite directions, this member crumpling when the critical load is applied. A further possibility is for two adjacent sections to hook directly together, at least one hook being designed to straighten and thus release when the critical load is applied.

In yet another further possible arrangement, one of two adjacent sections has a throat through which an end of the other of said two sections passes, that end having an enlargement beyond the throat which normally maintains the sections coupled. But when the critical load is applied the enlargement is capable of forcing its way through the throat.

Although it will generally be the case that the same type of coupling will be used throughout the rod when there are more than two sections, at least one coupling can differ from another, the different couplings being selected for example from those outlined above.

When a wall is reinforced by such a multi-section rod and is non-uniform and has relatively weak and strong portions through which the rod passes, the energy absorbing couplings will generally be in the weak portions. A typical example is a reinforced concrete frame building with brick infills. The couplings would be within the brick to control the disintegration in the face of blast or seismic shock. The frame could be further reinforced using the defined method, the vertical and horizontal members being drilled to receive sleeved reinforcing rods subsequently encased by grout.

BRIEF DESCRIPTION OF THE DRAWINGS

For a better understanding of the invention, some embodiments will now be described, by way of example, with reference to the accompanying drawings, in which:

Referring now to FIG. 1, this shows a window anchorage comprising a reinforcing bar 10, a fabric sleeve 11 encasing all but one end of the bar, a plate 12 and a nut 13 threaded on that one end. The other end is bent back so that the bar assumes the shape of a narrow J. Near said one end, the bar 10 is slightly cranked so that the axis of the nut 13 is aligned with the centre of the bight of the J.

Figure 1:
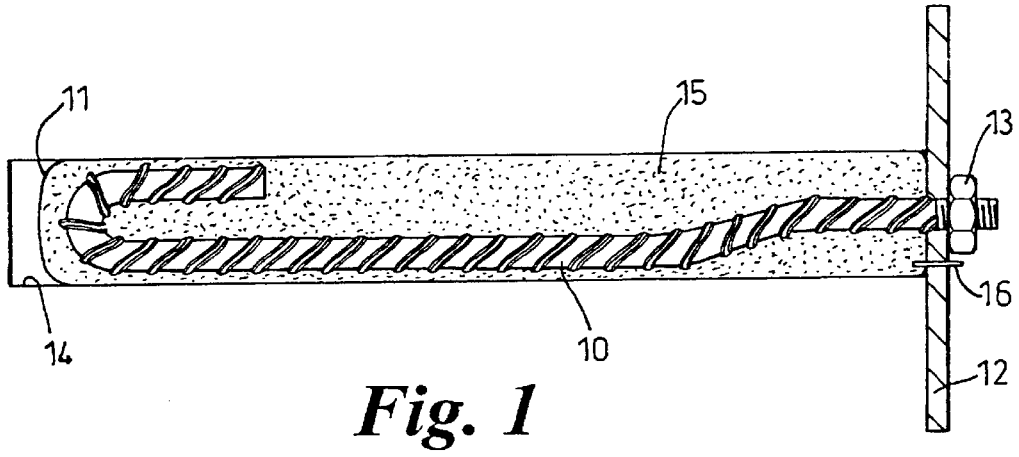
FIG. 1 is a longitudinal section of a window anchorage.

Any existing frame having been removed, the reveal of a window aperture is drilled between the faces of the wall, and this anchorage is inserted into the drilling 14 until the plate 12 comes up against the reveal. The nut 13 will have been threaded on to locate the plate 12, but will not have been turned right down to the end of thread. Then grout 15 is injected into the sleeve 11 through a small passage 16 in the plate 12 and allowed to set. The nut 13 may then be tightened against the plate 12.

The anchorage may be secured without the plate 12 or nut 13; they may be fitted only after the grout has set.

Several of these anchorages can be provided around the window aperture, and then the frame is fitted.

The nature of the frame will largely dictate how this is done and it will be understood that the plates 12 may actually be part of the frame, and could have a more complex shape. For example, if the primary purpose of the anchorage was to prevent the frame from being blown inwards, the frame members could have a square U-shaped cross-section, the web of the U being outermost (in relation to the wall) and the outer limbs (in relation to the aperture) being notched to fit over the projecting bars 10. The nuts 13 would then be tightened against the inside of the outer limbs to clamp the frame in place.

Another possibility is for the plates 12 to have flanges projecting into the aperture, against which the frame can be abutted and secured. The ends of the bars 10 projecting beyond the nuts 13 could be trimmed off and the flanges would be deeper than the thickness of the nuts. This would leave only a narrow gap around the frame to be covered or filled in. The filling could be similar to the anchorage, with grout being injected to fill a fabric sleeve surrounding the frame.

A further arrangement, to allow the frame to fit even more closely into the aperture, eliminates the nut 13 and the projecting end of the bar 10. Instead the bar is wholly within the drilling and presents a screw-threaded socket in its end face, which will be substantially flush with the reveal. The frame is drilled at points to register with these sockets and, when correctly in place, screw bolts are entered through the frame and tightened into the bars 10.

Rather than set the anchorages into the wall before offering up the frame, it may be preferred to put the bars 10 with their sleeves 11 loosely into the drillings, offer up the frame and secure that to the bars, and then inject grout simultaneously into all the anchorages via tubes extending through the frame if necessary but preferably between the frame and the reveals.

Figure 2:
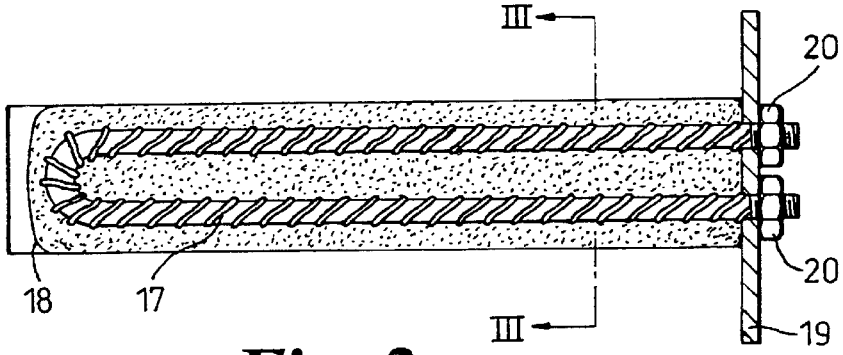
FIG. 2 is a longitudinal section of another window anchorage.
Figure 3:
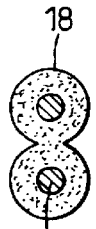
FIG. 3 is a cross-section on the line III—III of FIG. 2.

FIGS. 2 and 3 show a variation on the anchorage of FIG. 1 where two overlapping drillings are made, and a reinforcing rod 17, again encased in a sleeve 18 for grout injection, is of elongate U-form with its two free ends extending through a plate 19 and fitted with nuts 20.

Figure 4:
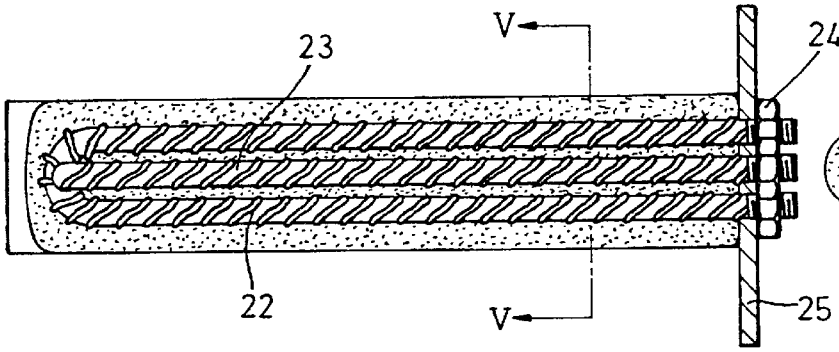
FIG. 4 is a longitudinal section of a further window element.
Figure 5:
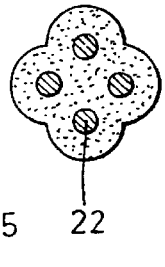
FIG. 5 is a cross-section along the line V—V of FIG. 4.

An even more substantial version is shown in FIGS. 4 and 5, where there are four overlapping drillings 21 and two U-shaped reinforcing rods 22, 23 nested together with their planes at right angles. This means four nuts 24 clamping a plate 25 in place.

Figure 6:
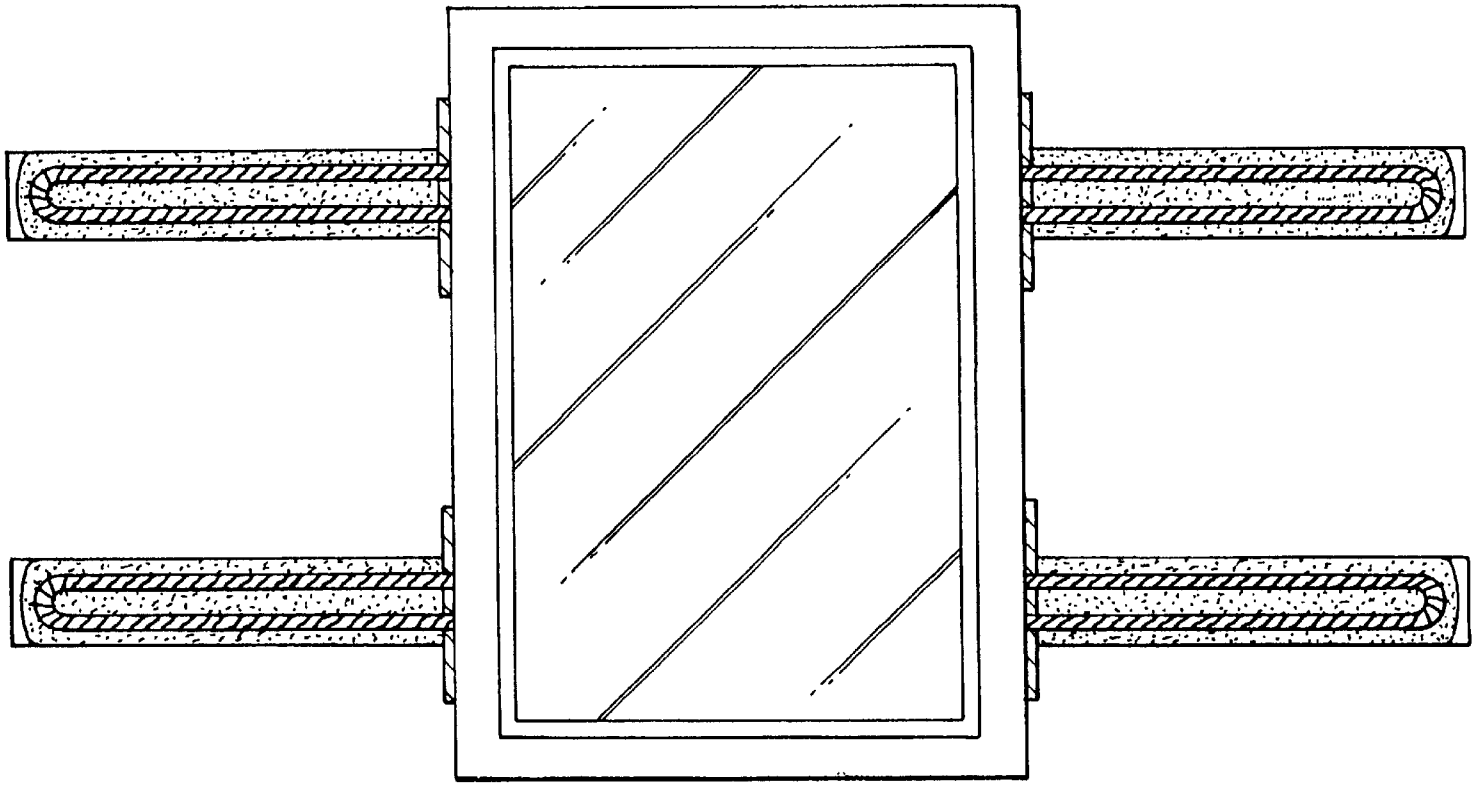
FIG. 6 is a face view of a window secured by anchorages of FIG. 2.

FIG. 6 shows a window secured by four anchorages of the type shown in FIGS. 2 and 3.

Figure 7:
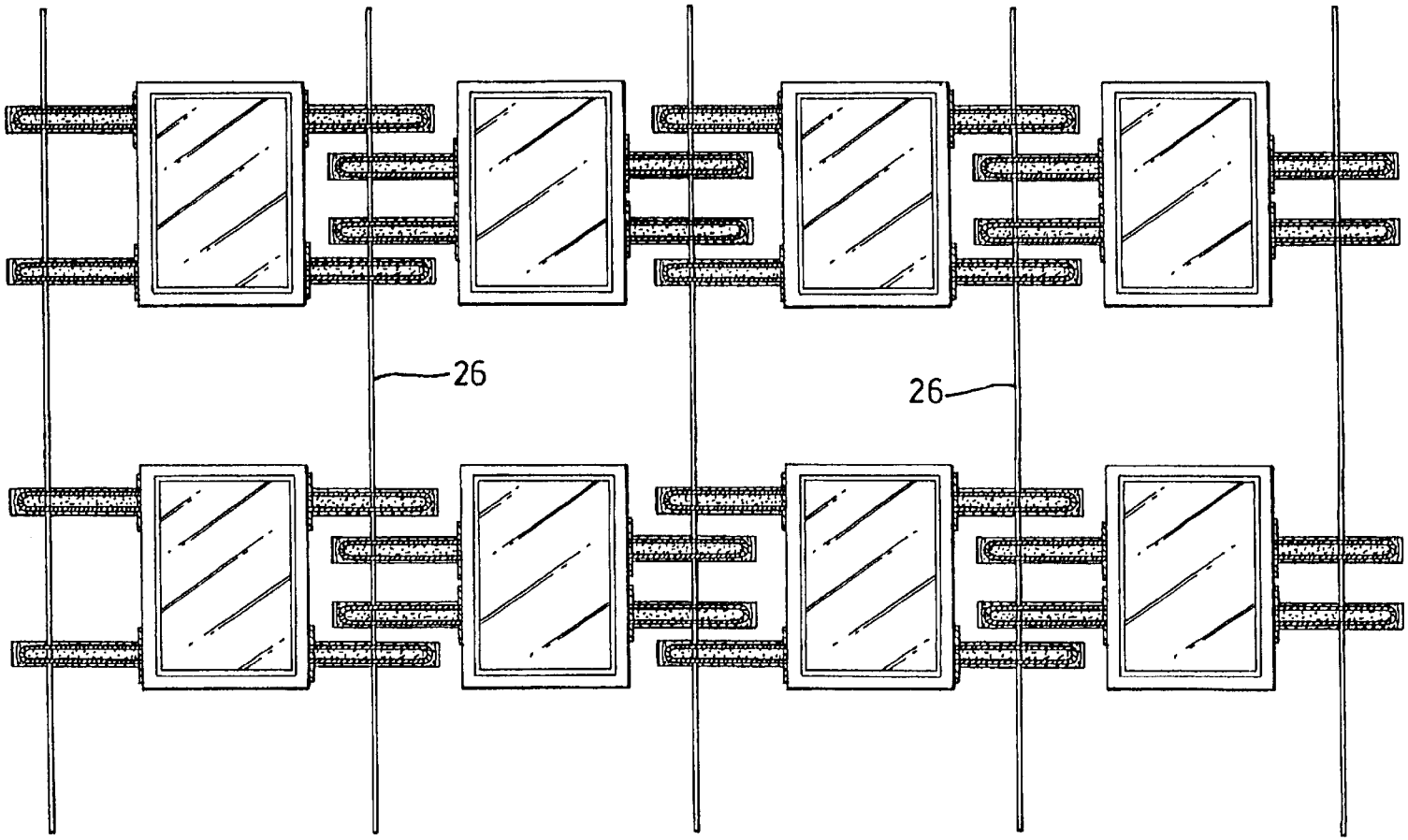
FIG. 7 is a face view of several windows as in FIG. 6, with further, common anchorage elements.

FIG. 7 shows a rectangular matrix array of such windows. Because of their spacing, the positions of the anchorages have to be staggered, as they overlap within the wall. Although shown with their planes vertical, in practice each anchorage will preferably be turned at right angles so that the plane of each U will be horizontal. The wall may then be drilled vertically, the drillings passing down through the limbs of the U-shaped bars. The drill bit is then replaced by a reinforcing rod 26 encased in a fabric sleeve as described above. When grouting is complete, the anchorages are positively linked or hooked to these rods, and the entire set of windows is a cohesive network.

It would be useless to pretend that extra reinforcement can keep a building intact in all circumstances. It is realistic to concede that there will be damage given a certain power of blast or seismic shock. However, if the energy can be absorbed harmlessly to some extent, the damage can be semi-controlled.

Figure 8:
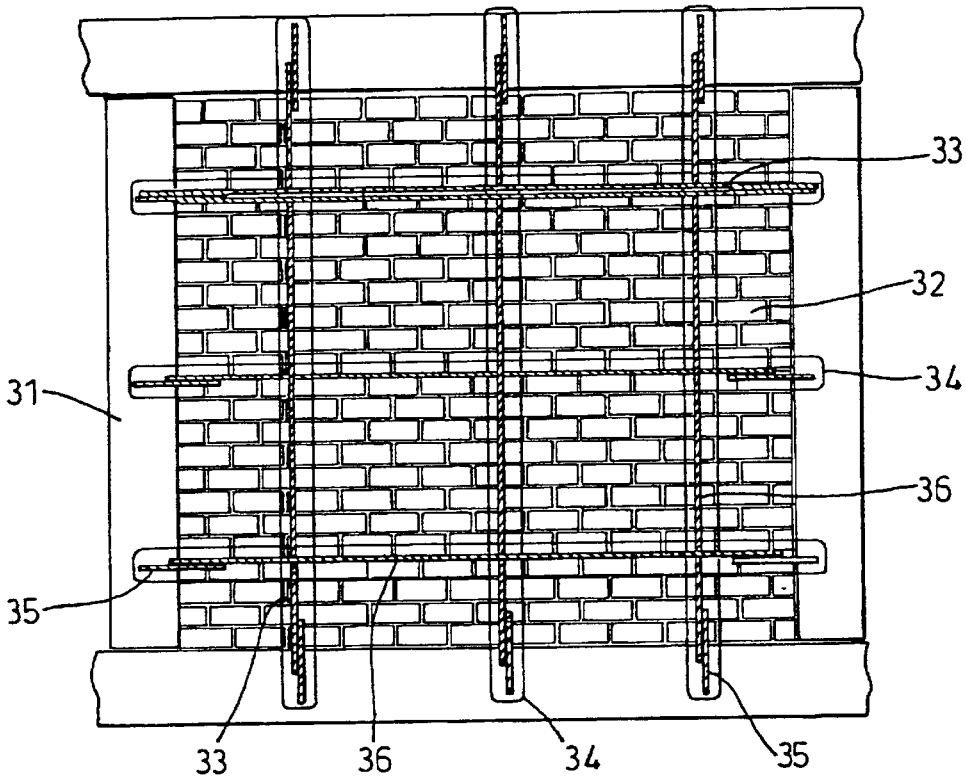
FIG. 8 is a face view of a portion of the wall of a reinforced concrete frame building with brick infills.

Referring now to FIG. 8, a reinforced concrete frame 31 has a brick infill panel 32. This is further reinforced by making drillings in a grid pattern, inserting rod assemblies 33, each encased in a fabric sleeve 34, into the drillings, and injecting grout to expand and fill the sleeves. Some of the grout seeps through to bond to the bricks and concrete.

The rod assemblies 33 in this example each comprise short rods 35 attached in overlapping manner to the opposite ends of main rods 36. The overlaps coincide with the discontinuities between frame 31 and panel 32, but it will be understood that they can be anywhere along the rod assemblies 33 and there could be several for each assembly (that is each rod 36 could be a composite).

Various possible connections between rods are illustrated in FIGS. 9 to 15.

Figure 9:
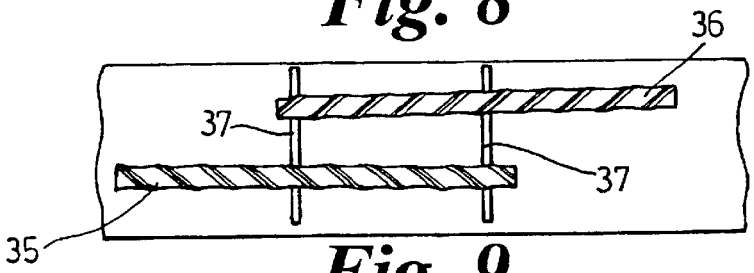
FIGS. 9 to 15 are details showing different ways of coupling reinforcing rods.

In FIG. 9 the ends of the rods 35 and 36 overlap but are spaced apart by two links 37 transverse to this length. The rods are forced through apertures in those links. If the panels 32 are blasted with sufficient force to shift it, the rods will have to tear out of the links 37, at the same time breaking down the grout that encases them.

Figure 10:
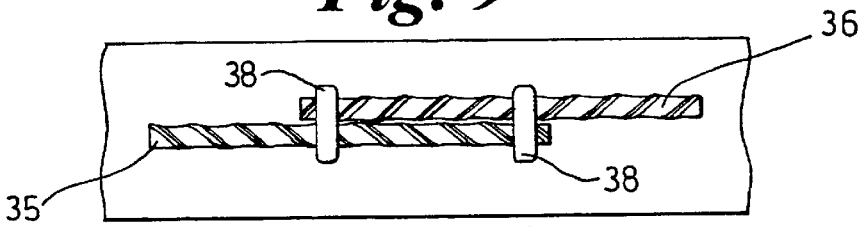

In FIG. 10 the rods 35 and 36 are mutually fastened by straps 38. These may be several turns of wire, for example, designed to unravel or part at a particular load. Or they may be metal rings crimped into a figure-of-eight around the rods.

Figure 11:
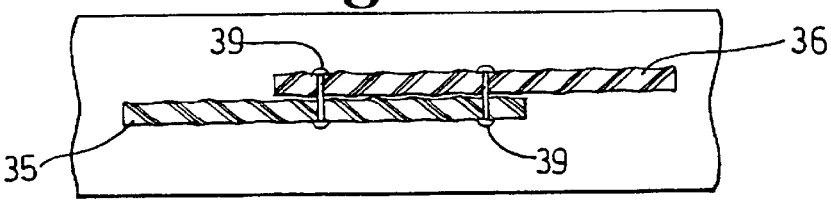

In FIG. 11 the rods 35 and 36 are transversely drilled and, with the drillings in registry, shear pins 39 are inserted and their ends rivetted.

Figure 12:
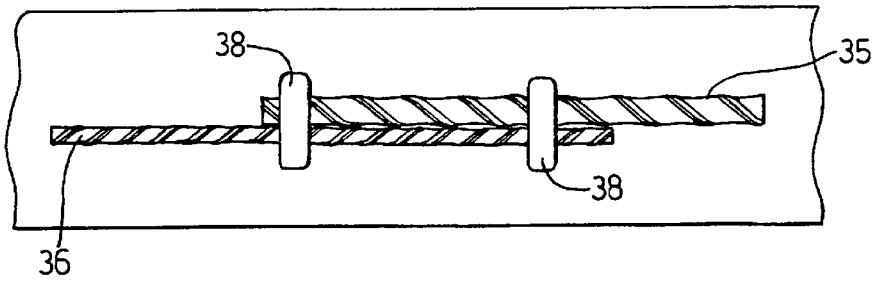

In FIG. 12 the arrangement is similar to FIG. 10 except that the one rod 36 is of lesser diameter than the other rod 35.

Figure 13:
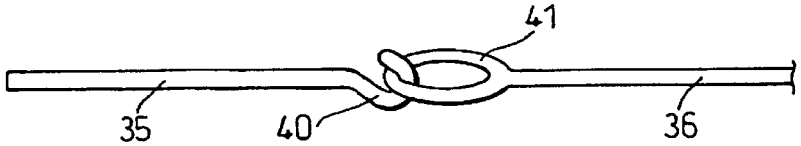

In FIG. 13 the end of the rod 35 is formed as a hook 40 and the end of the rod 36 is formed as an eye 41 in which the hook 40 engages. At a certain load, the eye 41 pulls the hook straight or at least bends it so that rod 36 is released.

Instead of the eye 41 there could be another hook so that only one of the two hooks has to work properly.

Figure 14:
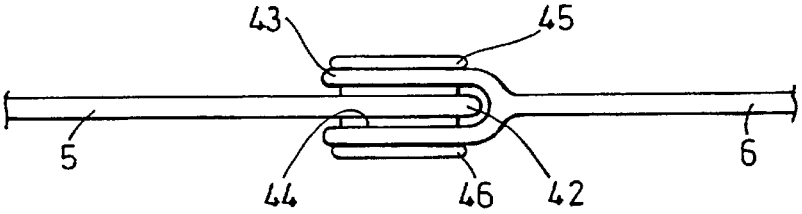

In FIG. 14 the end of the rod 35 is formed into an eye 42, and the end of the rod 36 is formed into a clevis 43 into which the eye 42 can enter. The two limbs of the clevis are apertured and through them and the eye 42 is entered a hollow cylindrical body 44. One end flange 45 can be pre-formed, and the other flange 46 may be formed after insertion, by axial pressure for example, to retain the body 44 in place. At a critical load, the body 44 will crumple, allowing the rods to move apart and eventually separate when one or both flanges 45 and 46 pull through the apertures in the clevis 43.

Figure 15:
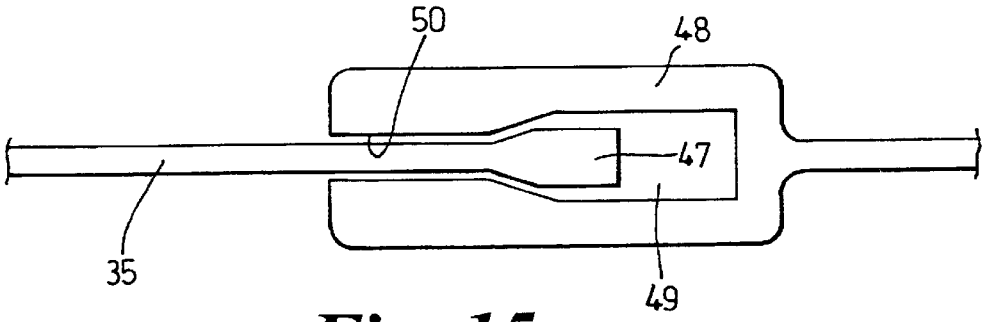

In FIG. 15 the end of the rod 35 has an enlargement 47 while the end of the rod 36 has an aligned cylindrical member 48 with a bottle shaped chamber 49, the neck or throat 50 of the bottle opening away from the rod 36. The enlargement 47 is trapped in this chamber 49, seating into the shoulder where the neck or throat 50 begins. But when a predetermined load is sustained, the neck or throat 50 gives way and expands, allowing the enlargement 47 to escape, and/or the enlargement 50 is squeezed into a body of lesser girth with the same result.

What is claimed is:

1. A method of reinforcing the anchorage of a frame in an aperture in the wall of a building, the method comprising making a first drilling (14) into the reveals of the aperture from within the aperture, the drilling being between the inner and outer faces of the wall, inserting a reinforcing rod (10,17,22) enveloped by a loose fabric sleeve (11,18) into the first drilling, the proximal end of the rod being secured or securable to a frame within the aperture, and inserting grout to expand the sleeve against the wall of the associated first drilling to penetrate through the fabric and bond to the wall, characterised in that the rod (10,17) is curved back on itself at the distal end from the frame to form a loop, and the plane of the loop is substantially at right angles to the wall, and in that a second drilling is made into the wall between its two faces when the grout has set so that the drill bit passes through the loop, an extra reinforcing rod (26) enveloped by a loose fabric sleeve is inserted into the second drilling, and grout is injected to expand that sleeve against the wall of the second drilling to permeate through the fabric and bond to the wall.

2. A method as claimed in claim 1, characterised in that the loop is open and the rod (10) is of thin U-shape.

3. A method as claimed in claim 1, characterised in that the rod (17) is of thin U-shape, with both ends proximal to and securable to the frame.

4. A method as claimed in claim 3, characterised in that there are two such U-shaped rods (22,23) within the same drilling, one shorter than the other and nested with their planes substantially at right angles.

5. A method as claimed in claim 1, characterised in that the aperture has a plurality of looped frame reinforcements along at least one side with the loops aligned to receive a common extra reinforcing rod (26).

6. A method as claimed in claim 5, characterised in that there is an array of apertures with a corresponding set of aligned sides, each such side having at least one. looped frame reinforcement, and a common extra reinforcing rod (26) being passed through all the loops associated with a set of aligned sides.

7. A method as claimed in claim 6, characterised in that there are two parallel arrays of apertures, the looped frame reinforcements of adjacent parallel sets of sides overlapping to be threaded by a common extra reinforcing rod (26).

8. A reinforcing rod for the method as claimed in claim 1, the rod being composed of a plurality of sections (35, 36) coupled by energy absorbing means (37, 38, 39, 40, 44, 47, 50) that fail at a predetermined critical load.

9. A reinforcing rod as claimed in claim 8, characterised in that there are more than two sections (35,36) and the critical loads of the couplings are not uniform throughout the rod.

10. A reinforcing rod as claimed in claim 8, characterised in that two adjacent sections (35, 36) overlap and are strapped together by an encircling element (37, 38) that serves as an energy absorbing coupling.

11. A reinforcing rod as claimed in claim 8, characterised in that two adjacent sections (35, 36) overlap, the overlapping portions being transversely drilled to receive a shear pin (39) that serves as an energy absorbing coupling.

12. A reinforcing rod as claimed in claim 8, characterised in that two adjacent sections (35, 36) hook around a hollow member (44) from opposite directions, this member crumpling when the critical load is applied and thereby serving an energy absorbing coupling.

13. A reinforcing rod as claimed in claim 8, characterised in that two adjacent sections (35, 36) hook directly together, at least one hook (40) being designed to straighten and thus release when the critical load is applied, thereby serving as an energy absorbing coupling.

14. A reinforcing rod as claimed in claim 8, characterized in that one (36) of two adjacent sections has a throat (50) through which an end of the other (35) of said two sections passes, that end having an enlargement (47) beyond the throat which normally maintains the sections coupled, but when the critical load is applied the enlargement (47) is capable of forcing its way through the throat (50).

15. A reinforcing rod as claimed in claim 8, characterised in that there are more than two sections, and least one coupling differs from another, the different couplings being selected from those claimed in claims 10 to 14.

16. A wall reinforced by a rod as claimed in claim 8, characterised in that the wall is non-uniform and has relatively weak and strong portions through which the rod passes, and wherein the energy absorbing couplings are in the weak portions.

* * * * *